United States Patent [19]

Fukukura et al.

[11] 4,450,324

[45] May 22, 1984

[54] ENCODED KEYBOARD SWITCH

[75] Inventors: Kazutoyo Fukukura, Reading; Richard A. Martinez, Stoneham, both of Mass.

[73] Assignee: AMP Incorporated, Harrisburg, Pa.

[21] Appl. No.: 502,369

[22] Filed: Jun. 8, 1983

[51] Int. Cl.³ ..... H01H 13/70

[52] U.S. Cl. ..... 200/5 A; 200/159 B; 200/292

[58] Field of Search ..... 200/5 A, 159 B, 292; 361/398

[56] References Cited

U.S. PATENT DOCUMENTS 4,081,898 4/1978 Taylor, Jr. et al. ..... 200/5 A X 4,356,358 10/1982 Fukukura ..... 200/159 B X

*Primary Examiner*—J. R. Scott

*Attorney, Agent, or Firm*—F. W. Raring

[57] ABSTRACT

Encoded keyboard switch comprises a single sheet of flexible film which has switch electrodes and circuit conductors applied to one surface. The sheet of film is folded to form four sections. After folding, the switch electrodes of the two upper sections are opposed to each other and the electrodes of the remaining two sections are opposed to each other so that when the folded film is pressed at a switch site, the two switches formed by the opposed electrodes are sequentially closed. The switch electrodes are interconnected in accordance with an improved encoding scheme which results in a reduced requirement in the number of circuit conductors, the elimination of some switch electrodes, and other advantages.

5 Claims, 11 Drawing Figures

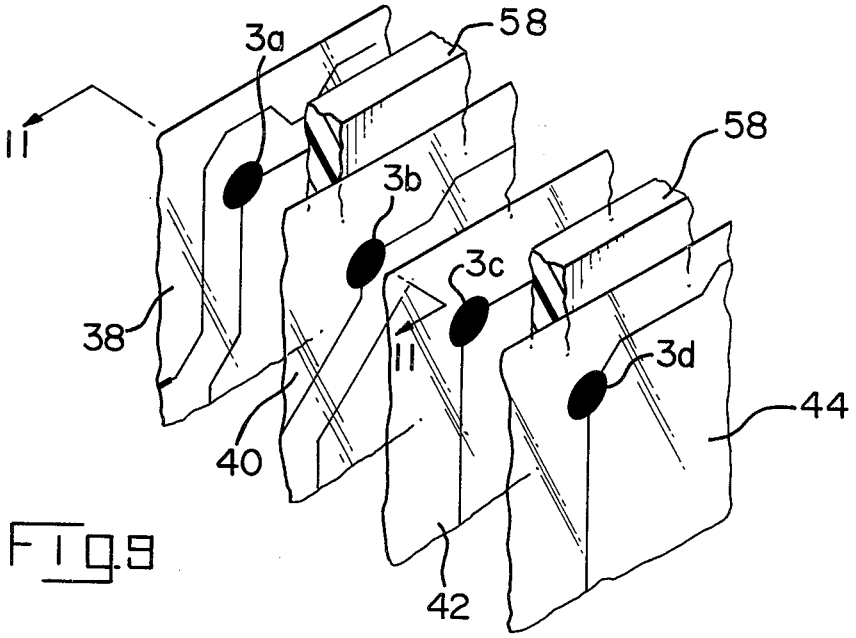
FIG. 9
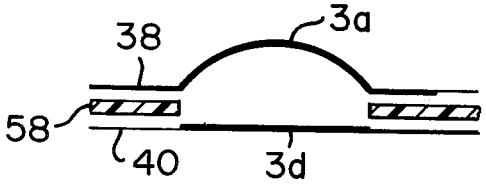
FIG. 11
| KEY POSITION | A | B | C | D | G |
|---|---|---|---|---|---|
| 1 | X | | | | X |
| 2 | | | X | | X |
| 3 | X | X | | | X |
| 4 | | X | X | X | X |
| 5 | | | X | X | X |
| 6 | | X | | | X |
| 7 | X | | X | | X |
| 8 | X | | X | X | X |
| 9 | | | | X | X |
| 10 | X | | | X | X |
| 11 | | X | | X | X |
| 12 | | X | X | | X |
FIG. 10

ENCODED KEYBOARD SWITCH

BACKGROUND OF THE INVENTION

U.S. application Ser. No. 285,898, filed July 23, 1981, describes an encoded keyboard switch composed of four sections of flexible film. A first and second section have opposed surfaces on which there are first switch sites and the third and fourth sections also have opposed surfaces on which there are second switch sites. The switch sites are located such that a second switch site is in alignment with, and is behind, each first switch site so that when the first section is pressed at a given switch site, the first associated membrane switch will initially be closed and thereafter the second membrane switch will be closed. The conductors interconnect the switch sites in accordance with an encoding scheme which is such that a characteristic signal is produced in output conductors. Two common ground conductors are provided in accordance with the teachings of the application Ser. No. 285,898 in a manner such that when a switch site is depressed, no signals will be sent through the output conductor until connections are made to the ground conductors. This feature prevents the transmission of erroneous signals when a multi-bit signal is being transmitted, that is, a signal in two or more of the output conductors.

The present invention is directed to the achievement of an improved encoded switch of the general class described in application Ser. No. 285,898. Specifically, the invention is directed to the achievement of an encoded membrane switch having a reduced number of circuit conductors and with a reduced requirement in the number of switch electrodes is the encoding scheme. These reduced requirements result in a simplification of a circuitry of the switch (from the standpoint of the number of conductors required) with a resulting improvement in ease of manufacture and a corresponding reduction in manufacturing costs.

An encoded keyboard switch in accordance with the invention comprises a single sheet of flexible insulating material which has been folded along fold lines to produce a stack of four sections of film in parallel aligned relationship. The stack comprises a first section, a second second, a third section, and a fourth section. The first and second sections have opposed surfaces on which there are provided a plurality of first switch sites and the third and fourth sections have opposed surfaces on which there are provided a plurality of second switch sites, each first switch site being in alignment with a second switch site. First switch electrodes are provided on the opposed surfaces of the first and second sections at first switch sites and second switch electrodes are provided on the opposed surfaces of the third and fourth sections at section switch sites. A common ground conductor and a plurality of signal bit conductors are provided on the opposed surfaces with selected conductors extending across the folds of the single sheet. A tail extends from the sheet and the signal bit conductors and the ground conductor extend onto the tail. The switch assembly is characterized in that selected first switch sites and selected second switch sites are electrically isolated from the signal bit conductors and from the common ground conductor. Selected second switch electrodes on the second section are two pole electrodes and all switch electrodes on the first, third and fourth sections are single pole electrodes. All second switch electrodes on the third section and selected first switch electrodes on the first section are connected to the common ground conductor. The routing of the signal bit conductors is in accordance with an encoding scheme which produces a unique signal in the bit conductors on the tail when a specific switch site on the first section is depressed, the signal being a multi-bit signal and being produced in a plurality of signal bit conductors on the tail when some switch sites are depressed and being a single bit signal and being produced in a single bit conductor on the tail when other switch sites are depressed whereby, upon depression of the first section at a location above a predetermined first switch site, the opposed surfaces of the predetermined first switch site will be moved into contact with each other, and thereafter the opposed surfaces of the second switch site which is beneath the predetermined first switch site will be moved into contact with each other. A unique signal will then be produced by a resulting circuit extending from the ground conductor on the tail through signal bit conductors to at least one signal bit conductor on the tail. When the unique signal is a multi-bit signal, the circuit will not be completed by the ground conductor until all of the switch electrodes required for the production of the multi-bit signal have been electrically connected to each other.

In accordance with a further embodiment, the first section has tactile effect means thereon at each of the first switch sites, the tactile effect means comprising domes in the first section which are concave with respect to the surface of the second section. In accordance with a further embodiment, the single sheet has parallel side edges and end edges, the sheet being folded along fold lines which extend normally of the side edges and the tail extends from one of the end edges.

In accordance with a further embodiment, the second section is at one end of the sheet, the first section is beside the second section and the fourth section is between the first section and the third section with the tail extending from the second section. The sheet has a slit therein which extends along a fold line which is between the first section and the fourth section. The second section is folded against the first section and the tail is inserted through the slit. The third section is folded against the fourth section, and the third and fourth sections are folded as a unit against the first and second sections.

DESCRIPTION OF THE DRAWINGS

FIG. 9 is a fragmentary exploded view of a portion of the folded membrane showing the alignment of a first switch site with a second switch site.

FIG. 10 is a truth table for the disclosed embodiment.

FIG. 11 is a fragmentary cross-sectional view looking in the direction of the arrows 11—11 in FIG. 9.

Figure 1:
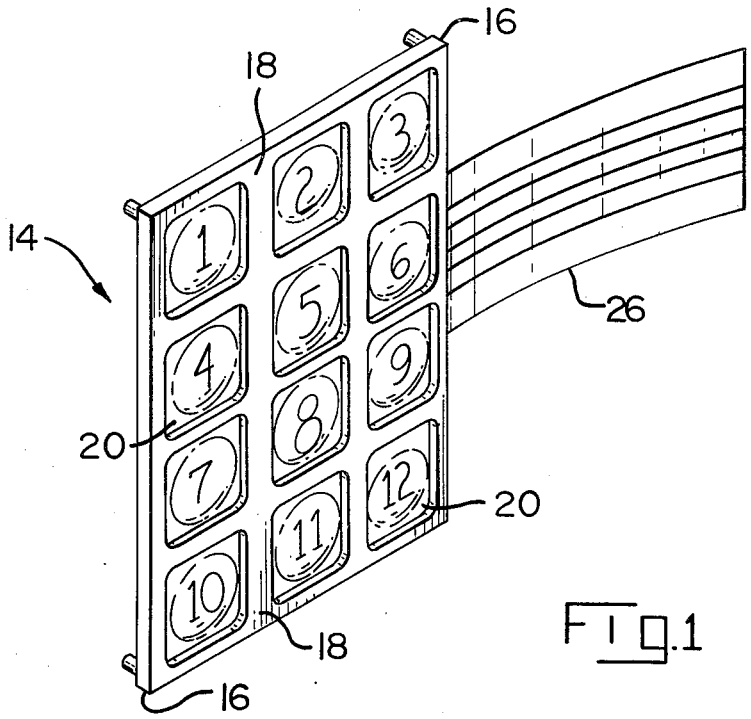
FIG. 1 is a perspective view of an encoded keyboard switch assembly in accordance with the invention.
Figure 2:
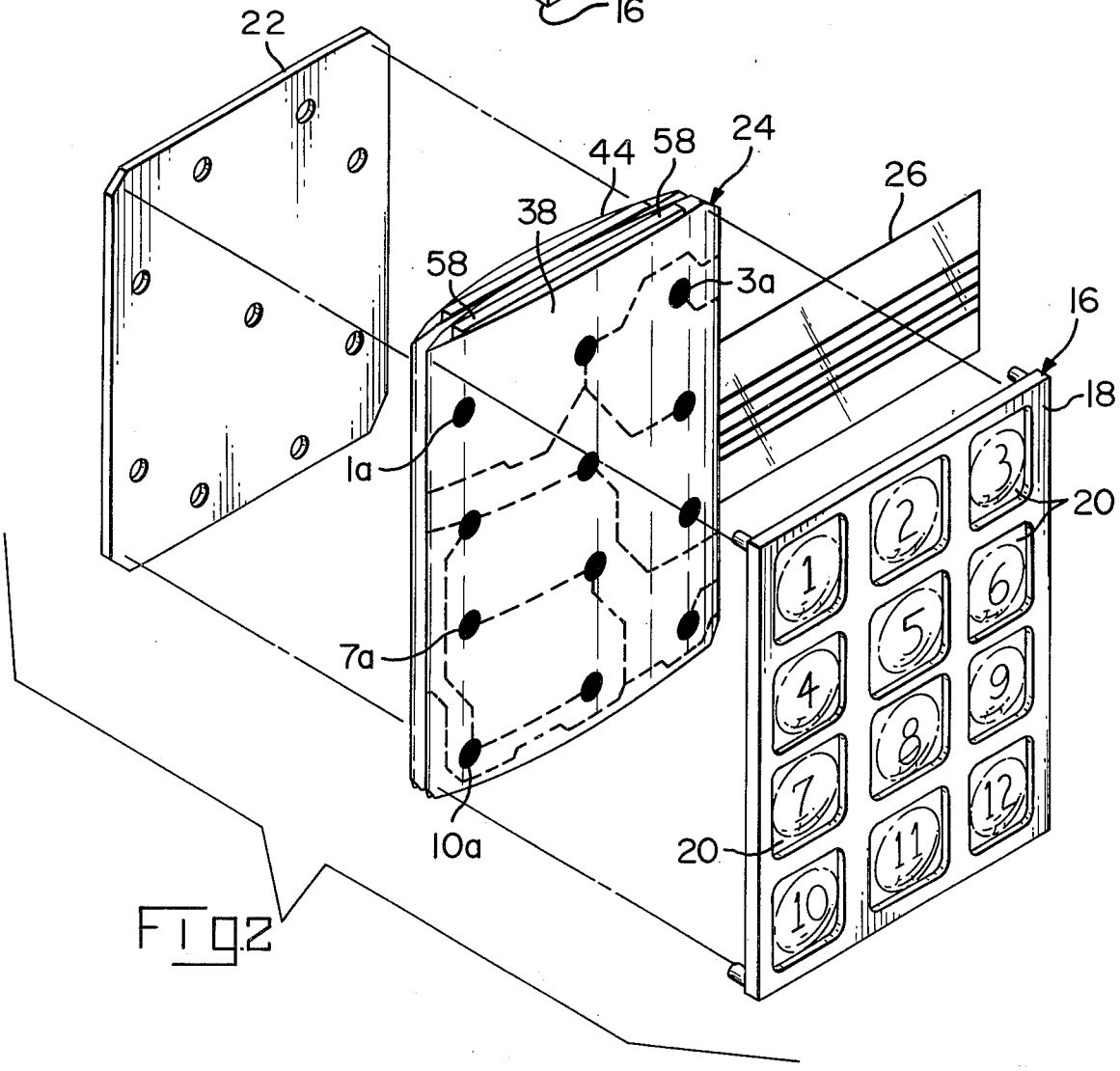
FIG. 2 is a view similar to FIG. 1 but with the housing parts exploded from the membrane circuit.

Referring first to FIGS. 1 and 2, a switch assembly 14 in accordance with the invention comprises a housing composed of a bezel 16 and a backing plate 22, which contains a membrane circuit 24. The bezel 16 has a face 18 having a number of key positions 20 thereon. In the embodiment shown, the key positions are numbered one to twelve and these key positions correspond to switch positions described below and identified by the same reference numerals. The assembly has a switch tail 26 extending therefrom on which there are output conductors and a ground conductor as described below. When a given key position is pressed, a characteristic signal is transmitted through one or more of the output conductors and this signal is generated entirely in the circuitry contained in the folded membrane 24.

Figure 3:
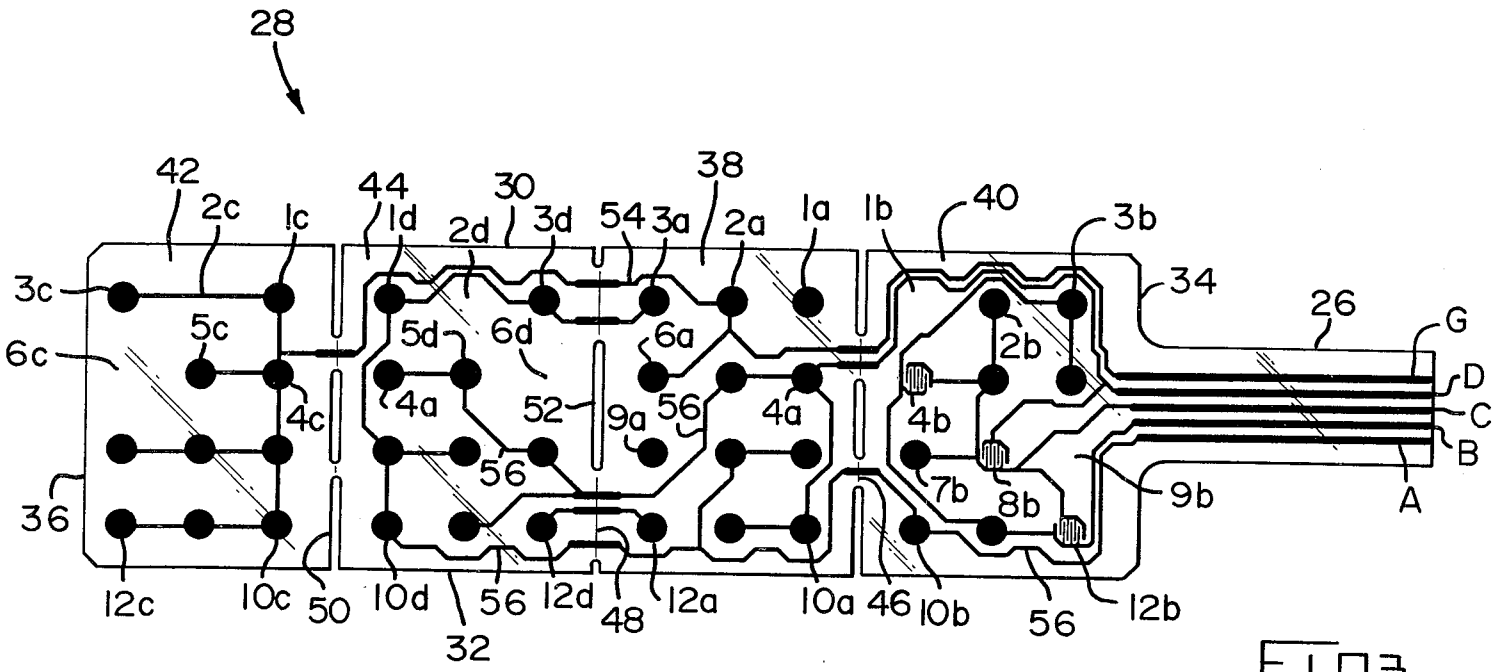
FIG. 3 is a plane view of the membrane prior to folding, showing the locations of the switch electrodes and the conductors extending between the electrodes.
Figure 4:
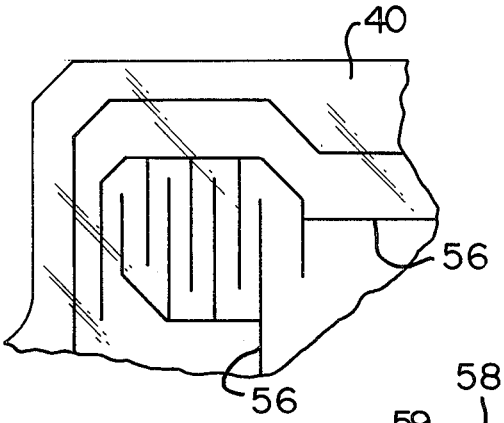
FIG. 4 is an enlarged fragmentary view showing details of an interdigitated two-pole switch electrode.
Figure 5:
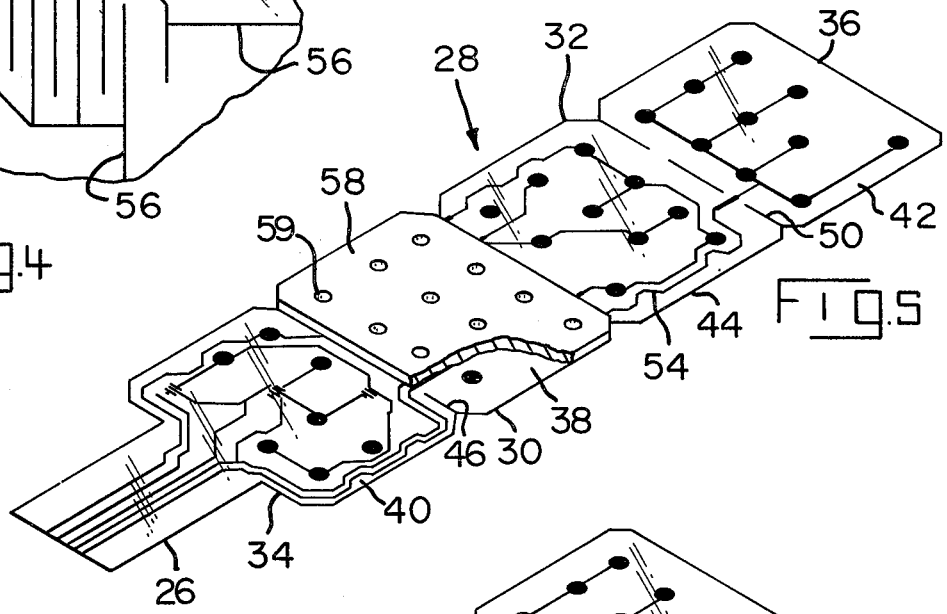
FIG. 5 is a plane view of the sheet of film having a separator thereon in preparation for the initial folding step.
Figure 6:
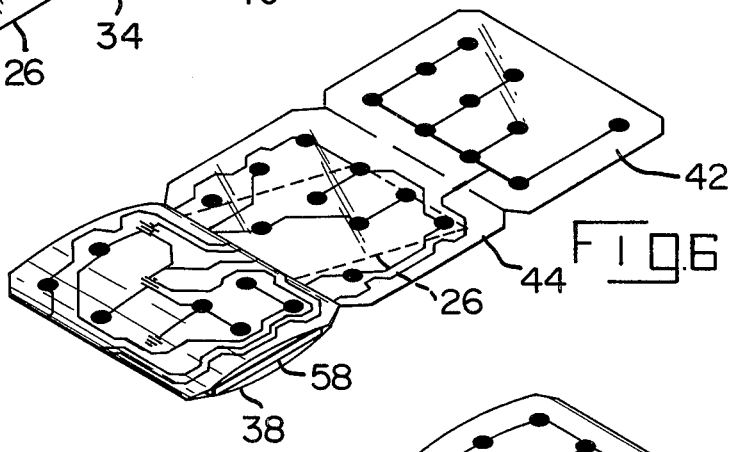
FIGS. 6, 7, and 8 are views illustrating the folding steps.
Figure 7:
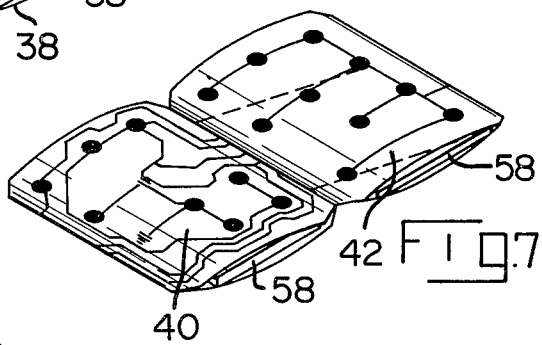
Figure 8:
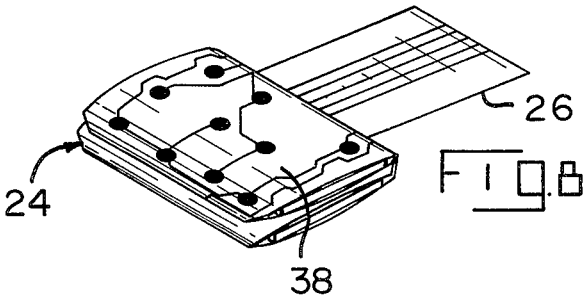

Referring now to FIG. 3, the membrane circuit 24 comprises a single sheet 28 of flexible film, such as polyester, which has been folded in the manner shown in FIGS. 5–8. The single sheet of film has parallel side edges 30, 32 and parallel end edges 34, 36. The folds are made along fold lines 46, 48, 50, which extend between the side edges 30, 32 and which divide the sheet into four sections 38, 40, 42, and 44. The section 38 is identified herein as the first section for the reason that it is the upper most section in the stack of sections after folding and is immediately adjacent to the face of the bezel 16 in the switch. Similarly, the section 40 is referred to as the second section, the section 42 as the third section, and the section 44 is referred to as the fourth section for the reason that these sections are in the order of the designation in the folded membrane circuit.

Folding is carried out as shown in FIGS. 5–8. A separator 58 having openings 59 therein at switch sites is placed on the surface of the first section 38 and the second section 40 is then folded along the fold line 46 towards the first section. The tail 26 which extends from the edges 34 of the second section 40 is inserted through an opening 52 in the fold line 48 so this tail will now extend below the surface of the film as shown by the dotted lines in FIG. 6. A separator is then placed against the surface of the fourth section 44 and the third section 42 is folded along the fold line 50 towards the fourth section 44, see FIGS. 6 and 7. Finally, the third and fourth sections 42, 44 are folded as a unit along the fold line 28 towards the first and second sections so that the stack of the four sections results.

After folding, the first and second sections 38, 40 have opposed surfaces on which there are provided a plurality of first switch sites. These switch sites are identified as 1*a*, 2*a*, 3*a*. . . 12*a* on the first section 38 and as 1*b*, 2*b*, 3*b*. . . 12*b* on the second section 40. Similarly, the third and fourth sections 42, 44 have opposed surfaces on which there are provided a plurality of second switch sites. On the third section 42, the switch sites are identified by the reference numerals 1*c*, 2*c*, 3*c*. . . 12*c*, and on the fourth section 44, the second switch sites are identified by the reference numerals 1*d*, 2*d*, 3*d*. . . 12*d*.

Most, but not all of the switch sites have switch electrodes indicated by the darkened circles on the four sections and the opposed electrodes thus form an individual switch. It will be noted, however, that no electrodes are provided at some of the switch sites, for example, 1*b*, 9*b*, 2*c*, 6*c*, 2*d*, and 6*d*. Electrodes are not required at these switch sites for reasons that will be explained below. It will also be noted that switch sites 1*a* and 9*a* are provided with conductive ink or other electrode material even though these switch sites are electrically isolated. In other words, the conductive material at 1*a* and 9*a* does not perform an electrical connection. The reasons for the provision of the conductive material at 1*a* and 9*a* will be described below.

The electrodes on the first, second, and third sections 38, 40, 44 are connected to each other as shown in FIG. 3 by signal bit conductors 56 which are so identified for the reason that they transmit characteristic signals of the switch positions to the tail 26. These conductors extend to signal outputs identified by the letters A, B, C, and D and the characteristic signal for a given key position will be a signal in one or more of the conductors A–D as indicated by the truth table of FIG. 10. It will be noted that the switch electrodes at 4*b*, 8*b*, and 12*b* are two-pole electrodes having interdigitated conductors. This arrangement is required to produce the multi-bit signals and the tail conductors A–D as can be determined by tracing the paths of the signal bit conductors 56 and referring to the truth table of FIG. 10.

The ground conductor 54 extends from the tail at G along the side of the sections 40, 38, and 44, to the section 42 at which it joins a grid of conductors that commonly connect all of the switch electrodes on the third section 42. It will be noted also that this ground conductor 54 extends to the switch electrode at 2*a* and that a conductor extends from electrode 2*a* to the electrode at switch site 6*a*. The necessity for this connection of the ground conductor 54 to positions 2*a* and 6*a* can be understood from a study of the truth table of FIG. 10. A signal bit conductor extends from switch site 2*b* to output line c on the tail. In order to complete the circuit, it is merely necessary then to make the electrode at 2*b* contact the electrode 2*a* on the first section 38. A circuit will then be completed extending from output conductor c to 2*b*, to 2*a*, and then to the grid g on the tail. Obviously then, it is unnecessary to provide an electrode at either 2*c* or 2*d*. The characteristic output signal for position six on the keyboard similarly is produced in the first and second sections 38, 40 and, therefore, electrodes are not required at 6*c* and 6*d*.

It is frequently desirable to provide domes at each of the switch sites 1*a*, 2*a*, 3*a*. . . 12*a* on the surface of the section 38 so that when a key position is pressed, the operator experiences a tactile effect in that a slight resistance is offered to collapse by the dome and the operator when collapse takes place and the switch has been closed. These domes as shown in FIG. 11 are produced in the film after the conductors and the electrodes have been produced on the surface as by silk screening a conductive ink. The domes are produced by heated dies which re-form the film when it is clamped between dome-shaped projections and depressions on the opposed surfaces of the dies. This process is quite critical and it is desirable that if the operating conditions and procedures of the process are established for sites having electrodes, it is desirable to provide metallization or conductive ink at sites 1*a*, and 9*a* even though the conductive ink applied does not serve an electrical function. In other words, if conductive ink were not applied at 1*a* and 9*a*, the heated dies might have a different effect at those sites than they would at the remaining sites on the first section and the domes may not be produced as desired or the film may be damaged.

It will also be noted that interdigitated two-pole conductors are required only on the second section 40 and are not required on the first section 38. This feature is advantageous in that the provision of interdigitated electrodes on the section 38 may also interfere with the formation of the domes at the switch sites on section 38.

It will be apparent from the foregoing discussion with reference to the truth table of FIG. 10 that the encoding scheme shown in FIG. 3 will produce a unique characteristic signal in the conductors A–D for each key position of the switch assembly 14. Moreover, the circuits are such and the signal bit conductors are routed in a manner such that no signals will be transmitted through conductors A–D until all of the components of a multi-bit signal have been assembled. Referring to the truth table for example, it will be seen that key position 4 when depressed, produces an output signal in B, C, and D. A study of the signal bit conductors will show that when position 4 is pressed, the signal bit conductors required for signal B, C, D must be connected to each other before the connection can be made to the ground conductor 54 at position 4c on section 42. False or misleading signals cannot therefore be produced in the case of multi-bit signals by premature connection of a signal bit conductor to the ground conductor 54.

As mentioned previously, the present invention is advantageous in that no interdigitated conductors are required on the first section 38 so that domes can readily be provided on this section. Further advantages of the invention will be apparent from an inspection of the circuit and the locations of the electrodes as shown in FIG. 3. The practice of the invention reduces the number and the lengths of the signal bit conductors, eliminates the need for a second ground conductor and eliminates the need for some electrodes. The simplification of the circuits results in lower manufacturing costs and higher reliability than were experienced with prior art circuits.

We claim:

1. An encoded keyboard switch of the type comprising a single sheet of flexible insulating material which has been folded along fold lines to produce a stack of four sections of film in parallel aligned relationship, the stack comprising a first section, a second section, a third section, and a fourth section, the first and second sections having opposed surfaces on which there are provided a plurality of first switch sites, the third and fourth sections having opposed surfaces on which there are provided a plurality of second switch sites, each first switch site being in alignment with a second switch site, first switch electrodes on the opposed surfaces of the first and second sections at first switch sites, second switch electrodes on the opposed surfaces of the third and fourth sections at second switch sites, a common ground conductor and a plurality of signal bit conductors on the opposed surfaces, selected conductors extending across the folds of the single sheet, and a tail extending from the sheet, the signal bit conductors and the ground conductor extending onto the tail, the switch assembly being characterized in that:

selected first switch sites and selected second switch sites are electrically isolated from the signal bit conductors and from the common ground conductor, selected second switch electrodes on the second section are two pole electrodes and all switch electrodes on the first, third and fourth sections are single pole electrodes, all second switch electrodes on the third section and selected first switch electrodes on the first section are connected to the common ground conductor, and the routing of the signal bit conductors is in accordance with an encoding scheme which produces a unique signal in the bit conductors on the tail when a specific switch site on the first section is depressed, the signal being a multi-bit signal and being produced in a plurality of signal bit conductors on the tail when some switch sites are depressed and being a single bit signal and being produced in a single signal bit conductor on the tail when other switch sites are depressed whereby, upon depression of the first section at a location above a predetermined first switch site, the opposed surfaces of the predetermined first switch site will be moved into contact with each other, and thereafter the opposed surfaces of the second switch site which is beneath the predetermined first switch site will be moved into contact with each other, and a unique signal will be produced by a circuit extending from the ground conductor on the tail through signal bit conductors to at least one signal bit conductor on the tail, and when the unique signal is a multi-bit signal, the circuit will not be completed by the ground conductor until all of the switch electrodes required for the production of the multi-bit signal have been electrically connected to each other.

2. An encoded keyboard switch as set forth in claim 1 characterized in that the first section having tactile effect means thereon at each of the first switch sites.

3. An encoded keyboard switch as st forth in claims 2 characterized in that the tactile effect means comprises domes in the first section which are concave with respect to the surface of the second section.

4. An encoded keyboard switch assembly as set forth in claim 1 characterized in that the single sheet has parallel side edges and end edges, the sheet being folded along fold lines which extend normally of the side edges, the tail extending from one of the end edges.

5. An encoded keyboard switch as set forth in claim 4 characterized in that the second section is at one end of the single sheet and the third section is at the other end of the sheet, the first section being beside the second section and the fourth section being between the first section and the third section, the tail extending from the second section, the sheet having a slit therein which extends along a fold line which is between the first section and the fourth section, the second section being folded against the first section and the tail being inserted through the slit, the third section being folded against the fourth section, and the third and fourth sections being folded as a unit against the first and second sections.

* * * * *